US007895791B2

(12) United States Patent
Miller et al.

(10) Patent No.: US 7,895,791 B2
(45) Date of Patent: Mar. 1, 2011

(54) PASSAGE BARRIER WITH A SENSOR TECHNOLOGY FOR DETECTING THE PRESENCE OF A PERSON INSIDE THE PASSAGE BARRIER

(75) Inventors: Norbert Miller, Mönchengladbach (DE); Michael Sauermann, Monchengladbach (DE)

(73) Assignee: Scheidt & Bachmann GmbH (DE)

( * ) Notice: Subject to any disclaimer, the term of this patent is extended or adjusted under 35 U.S.C. 154(b) by 676 days.

(21) Appl. No.: 11/803,412

(22) Filed: May 14, 2007

(65) Prior Publication Data

US 2007/0271846 A1 Nov. 29, 2007

(30) Foreign Application Priority Data

May 16, 2006 (EP) ..... 06010071

(51) Int. Cl.
*E05D 15/02* (2006.01)

(52) U.S. Cl. ..... 49/42; 49/31; 49/44

(58) Field of Classification Search ..... 49/42, 49/31, 44, 45, 46
See application file for complete search history.

(56) References Cited

U.S. PATENT DOCUMENTS

| | | | | |
|---|---|---|---|---|
| 4,851,746 | A * | 7/1989 | Milke | 318/467 |
| 4,894,952 | A * | 1/1990 | Trett et al. | 49/25 |
| 5,414,249 | A | 5/1995 | Matsumoto | |
| 5,704,163 | A * | 1/1998 | Kocznar | 49/47 |
| 7,012,244 | B2 * | 3/2006 | Huff | 250/227.11 |
| 2005/0035277 | A1 * | 2/2005 | Matsuyama et al. | 250/221 |
| 2005/0241234 | A1 * | 11/2005 | Ginzel | 49/42 |
| 2007/0130833 | A1 * | 6/2007 | Maital | 49/31 |
| 2008/0110093 | A1 * | 5/2008 | Liles | 49/42 |
| 2008/0308322 | A1 * | 12/2008 | Augustyniak et al. | 177/1 |

FOREIGN PATENT DOCUMENTS

| | | |
|---|---|---|
| DE | 38 37 276 A1 | 11/1988 |
| DE | 93 20 892.8 | 3/1993 |
| DE | 93 14 530.6 | 9/1993 |
| GB | 2 175 348 A | 5/1986 |
| GB | 2 236 179 A | 5/1990 |

* cited by examiner

*Primary Examiner*—Gregory J. Strimbu
(74) *Attorney, Agent, or Firm*—Harness, Dickey & Pierce, P.L.C.

(57) ABSTRACT

A passage barrier includes at least one barrier element that can be swivelled around a swivelling axis inside a swivelling area; at least one sensor technology that detects the presence of a person in the swivelling area and that comprises at least one sending unit emitting detection waves, at least one reception unit providing output signals and an electronic evaluation unit for evaluating the output signals of the reception unit. The sending unit and the reception unit are located such that a detection wave of the detection waves extends from the sending unit through the barrier element in the swiveling area to the reception unit and wherein the barrier element is at least partially made of a detection wave transparent material. A method is also provided for operating the passage barrier.

11 Claims, 2 Drawing Sheets

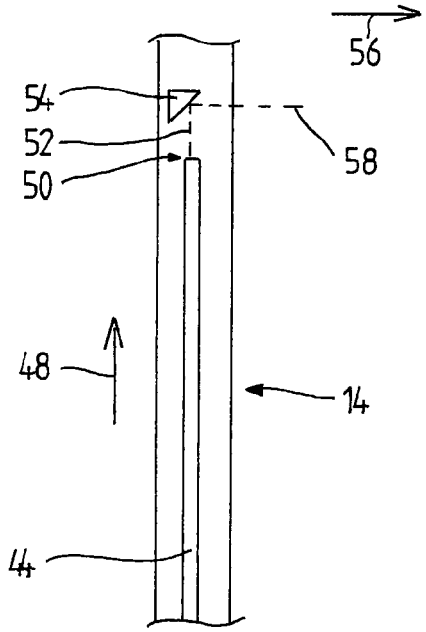
Fig. 2
Fig.3a
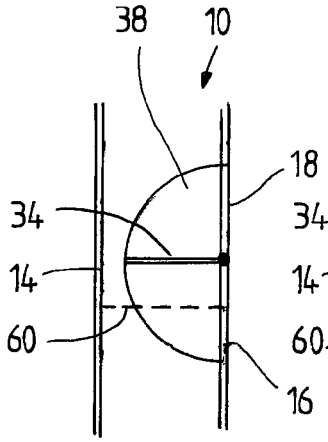
Fig.3b
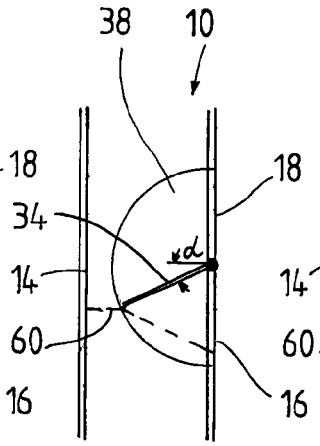
Fig.3c
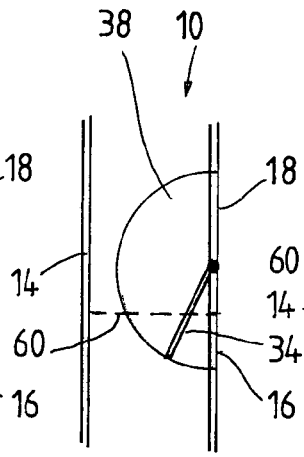
Fig.3d
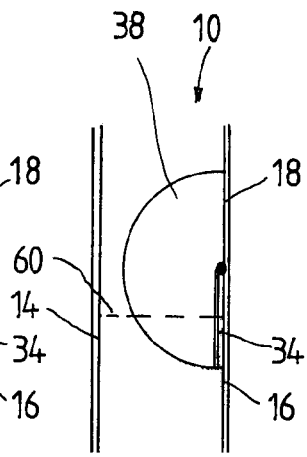

PASSAGE BARRIER WITH A SENSOR TECHNOLOGY FOR DETECTING THE PRESENCE OF A PERSON INSIDE THE PASSAGE BARRIER

BACKGROUND OF THE INVENTION

1. Technical Field

The present invention relates to passage barriers which serve to optionally open or block the passageway of a person or the passageway of a vehicle.

2. Discussion

An already known embodiment of such a passage barrier comprises a barrier element in form of an automatic sliding door that optionally opens or blocks a passageway by means of the passage barrier. In order to detect the presence of a person within the passageway of the passage barrier, this one can be equipped with a corresponding sensor technology. It is for example known to provide several light barriers along the passageway, the sending devices of which emit light beams that cross the passageway, which light beams are received by corresponding reception devices. If the light beam extending from a sending device towards a reception device is interrupted by a person, the input signal missing at the reception device will represent the presence of a person within the passage barrier, whereupon a corresponding evaluation unit will detect a person within the passage barrier. The use of several light barriers is advantageous in that both the position and the direction of movement of the person within the passageway of the passage barrier can be detected due to the fact which light beams will be interrupted in which order by the person that moves through the passage barrier. An essential drawback of such a sliding door design is however that this one requires a very large construction space due to the path of displacement of the sliding door, which is not desired for many practical applications.

An alternative embodiment of a known passage barrier comprises a barrier element that can be preferably swivelled automatically around a swivelling axis within a swivelling area, for example in form of a swinging door that optionally opens or blocks the passageway of the passage barrier. An important advantage of such passage barriers comprising swivelling barrier elements is that these ones require much less construction space in the direction of the width than the above described embodiment with a sliding door. The passage barrier comprising a swivelling barrier element can also be equipped with light barriers arranged along a passageway of the passage barrier in front of and behind the swivelling area, in order to detect the presence of a person in the passageway. However, the provision of light barriers within the swivelling area of the barrier element is problematic since these ones will be interrupted by the barrier element itself when it is swivelled, which is the reason why during the swivelling of the barrier element as well as when the barrier element is open it is not possible to know, based upon the output signals of the corresponding light barriers, whether a person is present in the swivelling area or not. Accordingly, an alternative sensor technology for detecting the presence of a person within the passageway of the passage barrier, such as for example a motion sensor or the like, will be preferably used for passage barriers comprising a swivelling barrier element. However, such sensors present the drawback that the precise position of a person within the passageway or the direction of movement thereof cannot be detected at all or only by means of very complex means.

GB 2 175 348 A describes an automatically controlled passage barrier comprising a swivelling barrier and a scanning device, wherein the barrier is opened and afterwards automatically swivelled back into the closed position after detection of an object or a person by means of the scanning device. In order to assure that for example children who eventually stop their motion in the area of the barrier will not be hurt by the barrier that automatically closes after a determined time interval, the assembly comprises another scanning device which determines whether a person is present in the area of the barrier, whereby the barrier will be kept in its open position as long as the other scanning device detects no more person in the scanned area.

DE 9314 530 U1 describes a swivelling door for a passageway of persons comprising a swivelling door leaf and sensors connected therewith via control means. These sensors are adapted to determine whether a person is present in the passageway of persons, such that a warning signal can be emitted if for example the person wants to illegally leave a shop provided with such a passage barrier through the passage barrier. For this, the several sensors are arranged in such a way that they can detect the direction of movement of a person who moves in the passageway of persons, whereby the control means of the swivelling door can detect an illegal use of the passageway of persons.

OBJECTS AND SUMMARY OF THE INVENTION

Based upon the above described state of the art, it is the object of the present invention to provide an alternative and improved passage barrier comprising a barrier element that can be swivelled around a swivelling axis inside a swivelling area, a sensor technology that detects the presence of a person in the swivelling area and a corresponding electronic evaluation unit for evaluating the output signals of the sensor technology.

The passage barrier according to an embodiment of the present invention comprises at least one barrier element that can be swivelled around a swivelling axis inside a swivelling area, at least one sensor technology that detects the presence of a person in the swivelling area and that comprises a sending unit emitting detection waves as well as at least one reception unit and an electronic evaluation unit for evaluating the output signals of the sensor technology. The at least one swivelling barrier element can be for example one or more swivelling doors, a turnstile or the like. The detection waves are preferably light beams, wherein also other detection waves can be used, such as for example ultrasound waves or the like.

According to the invention, the sending unit and the reception unit of the sensor technology are located such that a detection wave extending from the sending unit towards the reception unit extends through the swivelling area of the barrier element, wherein the barrier element is at least partially made of a detection wave transparent material. In the area of the detection wave transparent material of the barrier element the detection wave emitted by the sending unit can also pass the barrier element in the swivelled position, which is the reason why the presence of a person can also be detected inside the swivelling area during the swivelling motion of the barrier element and when the barrier element has been swivelled. Herein, the detection wave transparency of the material is preferably as high as possible in order to prevent a reduction of the intensity of the detection waves while these ones penetrate the barrier element. Furthermore, it is a big advantage if the detection wave transparent material does not refract or hardly refracts the detection wave that penetrates it, such that the direction of a detection wave is maintained during penetration of the barrier element. In this way, the structure and the arrangement of the sensor technology as well as the evaluation of the output signals of the reception devices can be considerably simplified.

Thus, a passage barrier is created that only requires a small construction space in the direction of the width and that enables to safely detect the presence of a person inside the swivelling area of the barrier element. If several sending and reception devices are provided along the passageway of the passage barrier, also the precise position as well as the direction of movement of a person who is present in the passageway of the passage barrier including the swivelling area can be detected.

The detection wave transparent material of the barrier element is preferably glass or plastic which transmits a pre-determined range of wavelength, wherein these materials should present a very high transparency with respect to the corresponding wavelengths and should not cause a refraction of a light beam that penetrates the material.

The at least one sending unit and the at least one reception unit are preferably accommodated in partition walls that are placed opposite each other and that at least partially define a passageway through the passage barrier, whereby an especially simple structure of the passage barrier is obtained since no additional holding elements for the sending and reception units have to be provided.

The sending unit is connected to a detection wave generating source preferably via at least one waveguide, for example to a light source via an optical waveguide. An essential advantage of this structure is that a plurality of sending devices can be connected to a single source via a corresponding number of waveguides. Furthermore, waveguides can be easily placed and do only require very small construction space.

The sending unit preferably comprises a deviation device for detection waves, for example a mirror, if the detection waves are light waves. A waveguide in combination with such a deviation device for detection waves is advantageous in that the wave outlet end of the waveguide does not have to point into the direction into which the detection wave shall leave the waveguide. Accordingly, the wave outlet end of the waveguide does not have to be bent, which normally requires a relatively high construction space. Accordingly, waveguides that are placed in partition walls can be placed completely in parallel to the great surfaces of the partition walls, wherein the detection waves leave the waveguide also into a direction that is parallel to the great surfaces of the partition walls and are finally deviated into a pre-determined direction by means of the deviation device for detection waves that only requires less construction space, which will be described in detail in the following with reference to FIG. 2.

If the passage barrier according to the invention comprises partition walls, these ones will preferably, at least partially comprise a detection wave transparent material, such that the partition walls do not have to be provided with outlets for the detection waves. In this manner, the production costs can be reduced on the one hand and the outer appearance of the passage barrier can be improved on the other hand. According to another embodiment of the passage barrier according to the invention, this one preferably comprises a sensor technology for detecting a swivelling angle of the barrier element. This is in particular advantageous, if it has to be assumed that a detection wave emitted from the sending unit will be refracted in one or more pre-determined swivelling angles of the barrier element due to the design or shape thereof, such that the detection wave will not meet the reception unit that is allocated to the sending unit. Such refraction can be for example caused by the free vertical edge of a common swivelling door when the edge is swivelled through the detection wave. Such swivelling angles or swivelling areas can be accordingly considered in the evaluation of the output signals of the sensor technology, in order to prevent detection errors.

Finally, the present invention relates to a method for operating a passage barrier of the above mentioned type, wherein the signals of the at least one sensor technology are evaluated in dependence on the swivelling angle of the at least one barrier element.

BRIEF DESCRIPTION OF THE DRAWINGS

In the following, the present invention will be described in detail by means of a preferred embodiment of the passage barrier according to the invention with reference to the drawing. Herein:

FIG. 1 is a perspective view of an embodiment of a passage barrier according to the invention and FIG. 2 is a plan view of a partition wall of the passage barrier represented in FIG. 1.

FIGS. 3*a* to 3*d* show schematic views of the passage barrier represented in FIG. 1, wherein the barrier element of the passage barrier is represented in respectively different swivelling positions.

DESCRIPTION OF THE PREFERRED EMBODIMENTS

Figure 1:
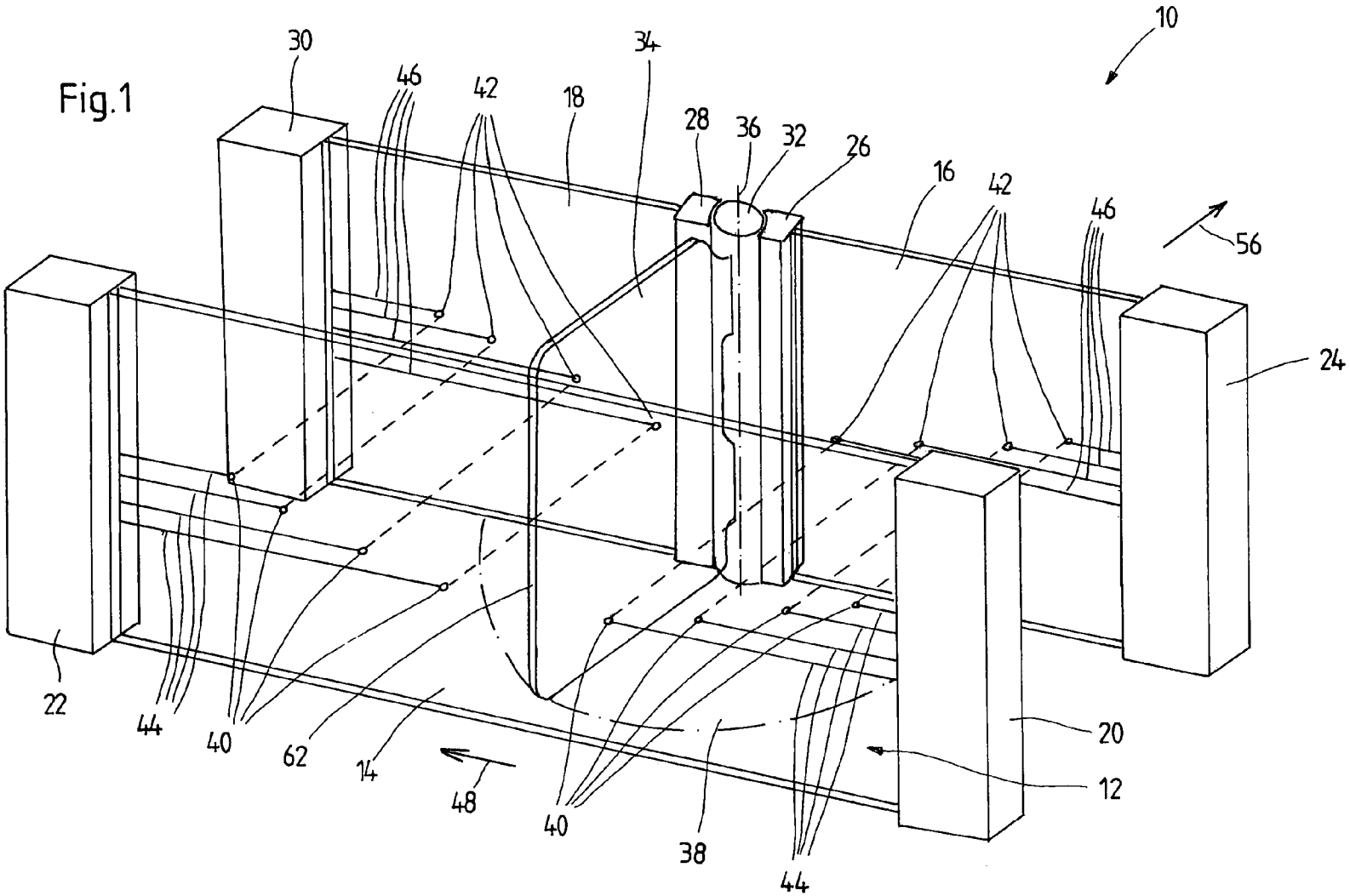

The same reference numerals will refer to the same components in the following description.

FIG. 1 shows a perspective representation of an embodiment of a passage barrier 10 according to the present invention. The passage barrier 10 comprises a passageway 12 that is limited on the one side by a partition wall 14 and on the other side by partition walls 16 and 18 that extend in parallel to the partition wall 14 and are arranged in true alignment with each other. The partition wall 14 is held between two post elements 20 and 22 which simultaneously serve as reception housings of electronic components. The partition walls 16 and 18 are also held between such post elements, wherein a motorized, vertical rotating shaft 32 is received between the post elements 26 and 28. A door like barrier element 34 is firmly connected to the rotating shaft 32, such that this barrier element can be swivelled together with the rotating shaft 32 around a swivelling axis 36 within a swivelling area 38 that is indicated in FIG. 1 by a semicircle. The barrier element 34 serves for optionally opening or blocking the passageway 12 of the passage barrier 10. It is made of a translucent material that hardly reduces the intensity of light beams penetrating the barrier element 34 and essentially does not cause any refraction of such light beams, such that these ones pass the barrier element 34 in nearly all swivelling positions without being subject to a change of direction. For detecting the presence of a person inside the passageway 12, the passage barrier 10 comprises a sensor technology. The sensor technology comprises a series of light sensors each having a sending unit 40 and a reception unit 42 that are integrated opposite each other in the partition walls 14 and 16 respectively 14 and 18. The sending units 40 emit detection waves in the form of light beams that are received by the corresponding reception units 42. For this, the sending units 40 are connected to a corresponding light source that is not represented in FIG. 1 via optical waveguides 44 that also extend in the partition wall 14. The sending units 40 can be connected to a common light source. Alternatively it is also possible that for example one light source is respectively received in the post elements 20 and 22. The structure of the sending units 40 will be explained in detail with reference to FIG. 2. The reception units 42 are connected via conductors 46 to a non represented evaluation unit which evaluates the output signals of the reception units 42 for detecting the presence of a person in the passageway 12 of the passage barrier 10. If one of the light beams between a sending unit 40 and an allocated reception unit 42, that is indicated in FIG. 1 by dashed lines, is interrupted by a person who moves through the passageway 12, this fact will be detected by the corresponding reception unit 42, whereupon the evaluation unit assumes the presence of a person. Since the sending and reception units 40, 42 are provided at different positions along the passageway 12, it is also possible by means of the fact which light beam has been interrupted to detect the precise position of the person inside the passageway 12. If furthermore the order is evaluated in which the light beams have been interrupted, the direction of movement of the person through the passageway 12 can also be detected.

FIG. 2 shows a plan view of a part of the partition wall 14 of the passage barrier 10 represented in FIG. 1. The optical waveguide 44 extends in the longitudinal direction 48 through the partition wall 14. At the free end 50 of the optical waveguide 44 a light beam 52 is decoupled in the longitudinal direction 48, which light beam meets a deviation device 54 that deviates it in the transverse direction 56, whereby the light beam 58 results. The deviation device 54 has the essential advantage that the optical waveguide 44 does not have to be bent into the transverse direction 56 for generating a light beam 58 in the transverse direction 58, for which a larger dimension of the partition wall 14 in the transverse direction 56 would be required. Due to the deviation device 54 the partition wall 14 can thus be formed smaller which helps to save material on the one hand and to produce an overall filigree impression of the passage barrier 10 on the other hand.

The optical waveguides 44 and the corresponding deviation devices 54 can be integrated in the partition wall 14 by for example providing corresponding recesses in the partition wall 14 which will be closed again after positioning of the components. Alternatively, the partition wall 14 can also be a multilayer element. For example, the partition wall 14 can have three layers, wherein the components are provided in the medium layer.

The partition walls 14, 16 and 18 are preferably made of a translucent material, such that the light beams emitted by the sending units 40 can pass the partition walls without having to provide additional recesses or the like. Furthermore, the material of the partition walls 14, 16 and 18 is preferably chosen such that the light beams emitted by the sending units 40 can penetrate the partition walls without being refracted and without any intensity losses.

FIGS. 3*a* through 3*d* schematically show the passage barrier 10 represented in FIG. 1 with the barrier element 34 in different swivelling positions. For the reason of simplicity only one light sensor is represented, the light beam of which is indicated by the dashed line 60.

If the barrier element 34 is in its blocking position as shown in FIG. 3*a*, the light beam 60 emitted by the sending unit 40 will be received by the reception unit 42 without any problems.

If the barrier element 34 is now swivelled around the angle α which is represented in FIG. 3*b*, the vertical free edge 62 of the barrier element 34 at first crosses the light beam 60. Due to the geometry of the edge 62 the light beam 60 will be refracted, such that this one no longer meets the allocated reception unit 42, which will produce an error with respect to the detection of a person.

If the barrier element 34 is now more swivelled beyond the angle α, cf. FIGS. 3*c* and 3*d*, the light beam 60 penetrates the barrier element 34 without being refracted due to the material thereof and meets the reception unit 42.

In order to eliminate the error produced in the swivelling angle α, the signals in the angle area around the angle α that have been transmitted from the reception unit 42 to the evaluation unit will not be considered in the evaluation. For this, the passage barrier 10 comprises a non represented sensor technology which detects the swivelling angle of the barrier element 34 and transmits this one to the evaluation unit.

It should be understood that the above described embodiment of the passage barrier according to the invention is not limiting. Modifications and changes are possible without leaving the scope of protection of the present invention that is defined by the annexed claims.

What is claimed is:

1. A passage barrier (10) comprising:

partition walls (14, 16, 18) defining a passageway (12) therebetween;

at least one barrier element (34) for optionally opening or blocking the passageway (12), wherein the barrier element can be swivelled about a swivelling axis through a swivelling area (38) of the passageway (12);

at least one sensor system that detects the presence of a person in the swivelling area, the sensor system comprising:

at least one sending unit (40) emitting detection waves, the sending unit (40) being arranged within one of the partition walls;

at least one reception unit (42) providing output signals in response to at least one of said detection waves, the reception unit (42) being arranged within another one of the partition walls opposite to said one of the partition walls; and an evaluation unit for evaluating the output signals of the reception unit;

wherein the sending unit (40) and the reception unit (42) are located such that said at least one of the detection waves extends from the sending unit (40) through the swiveling area to the reception unit (42), and wherein the at least one barrier element (34) is at least partially made of a material transparent to said detection waves such that the at least one of the detection waves extending through the swivelling area (38) passes through the at least one barrier element (34) without disrupting or substantially changing a direction of the at least one of the detection waves.

2. The passage barrier (10) according to claim 1, wherein the detection wave transparent material of the barrier element (34) is glass or plastic.

3. The passage barrier (10) according to claim 1, wherein the sending unit (40) is connected to a source generating the detection waves via at least one waveguide (44).

4. The passage barrier (10) according to claim 1, wherein the sending unit (40) comprises at least one deviation device (54) for the detection waves.

5. The passage barrier (10) according to claim 1, wherein the partition walls (14, 16, 18) at least partially comprise a material transparent to the detection waves.

6. The passage barrier (10) according to claim 1, wherein one side of the passageway (12) is defined by a pair of said partition walls (16, 18), the pair of said partition walls (16, 18)

being in the same vertical plane, and the swivelling axis is positioned between the pair of said partition walls (16, 18) in alignment with the plane.

7. The passage barrier (10) according to claim 1, wherein the passage barrier (10) comprises a sensor for detecting a position of the barrier element (34).

8. The passage barrier (10) according to claim 1, wherein the at least one sending unit includes a plurality of sending units and the at least one reception unit includes a plurality of reception units, the plurality of sending units being positioned within the one of the partition walls such that the plurality of sending units are vertically and horizontally offset from each other, and the plurality of reception units being positioned within the another one of the partition walls such that each of the reception units is aligned with a respective one of said sending units.

9. The passage barrier (10) according to claim 1, wherein an entire portion of the at least one barrier element that swivels through said swivelling area is made of the detection wave transparent material so as to not disrupt the at least one of the detection waves.

10. A passage barrier (10) comprising:

vertically extending partition walls (14, 16, 18) defining a passageway (12) therebetween;

at least one barrier element (34) for optionally opening or blocking the passageway (12), wherein the barrier element can be swivelled about a swivelling axis through a swivelling area (38) of the passageway (12);

at least one sensor system that detects the presence of a person in the swivelling area, the sensor system including:

a plurality of sending units (40) emitting detection waves, the sending units (40) being arranged within one of the partition walls such that the sending units (40) are vertically and horizontally offset from each other;

a plurality of reception units (42) providing output signals in response to the detection waves, the reception units (42) being arranged within another one of the partition walls opposite to the one of the partition walls such that the reception units (42) are vertically and horizontally offset from each other; and an evaluation unit for evaluating the output signals of the reception units;

wherein the sending units (40) and the reception units (42) are located such that at least one of the detection waves extends from at least one of the sending units (40) to a corresponding at least one of the reception units (42) through the swiveling area;

wherein the at least one barrier element (34) is made of a material transparent to the detection waves such that the at least one barrier element (34) is able to pass through the at least one of the detection waves extending through the swivelling area (38) without disrupting or changing direction of the at least one of the detection waves.

11. A method of operating a passage barrier (10) according claim 1, wherein the output signals of the at least one reception unit are evaluated in dependence on a position of the at least one barrier element (34).

* * * * *